US007811144B2

(12) United States Patent
Cavanaugh

(10) Patent No.: US 7,811,144 B2
(45) Date of Patent: Oct. 12, 2010

(54) AQUATIC DEVICE WITH LIGHT-EMITTING SURFACE

(75) Inventor: Jennifer J. Cavanaugh, Grand Prairie, TX (US)

(73) Assignee: Fresnel Technologies, Inc., Ft. Worth, TX (US)

( * ) Notice: Subject to any disclaimer, the term of this patent is extended or adjusted under 35 U.S.C. 154(b) by 202 days.

(21) Appl. No.: 12/217,707

(22) Filed: Jul. 7, 2008

(65) Prior Publication Data

US 2010/0003875 A1 Jan. 7, 2010

(51) Int. Cl.
*B63C 9/00* (2006.01)

(52) U.S. Cl. ..... 441/80; 441/74

(58) Field of Classification Search ..... 441/80, 441/74

See application file for complete search history.

(56) References Cited

U.S. PATENT DOCUMENTS

| | | | | |
|---|---|---|---|---|
| 6,459,076 | B1 * | 10/2002 | Schlenker | 250/205 |
| 7,238,075 | B2 * | 7/2007 | Brodsky | 441/80 |
| 2004/0247271 | A1 * | 12/2004 | Skovgaard et al. | 385/125 |

* cited by examiner

*Primary Examiner*—Stephen Avila
(74) *Attorney, Agent, or Firm*—John A. Fortkort; Fortkort & Houston P.C.

(57) ABSTRACT

An aquatic device is provided which has a light-emitting surface. The device (101) is equipped with a light guide (105) adapted to adsorb light impinging on a first surface (113) of the device, and to emit light from a second surface (115) of the device.

23 Claims, 19 Drawing Sheets

AQUATIC DEVICE WITH LIGHT-EMITTING SURFACE

FIELD OF THE DISCLOSURE

The present disclosure relates generally to aquatic devices or flotation devices, and more particularly to surf boards and other aquatic or flotation devices which have been optically modified to reduce the incidence of shark attacks.

BACKGROUND OF THE DISCLOSURE

Scientific studies have shown that shark attacks on humans have increased consistently over the last several decades (see FIGS. 1-2). This increase is directly correlated to the amount of time humans spend in the ocean. Since the 1990s, surfers have experienced the highest percentage of shark attacks.

Most shark attacks are believed to be cases of mistaken identity, where human beings are mistaken for seals, sea lions, sea turtles, and other natural prey of sharks. Sharks typically hunt for their prey by swimming along the ocean floor and looking for recognizable shapes at the surface of the water. From this position, a shark may mistakenly identify a surfer as a source of food, thus provoking an attack.

The fact that people are rarely eaten after being bitten by sharks supports the theory that sharks do not regard humans as food. Indeed, studies show that, in the majority of unprovoked shark attacks, the shark bites its victim, and then actually spits out the removed flesh. Some researchers in the field believe that sharks do not eat humans because human flesh is too boney and takes longer to digest than foods which form the staples of a shark's diet. This may, in turn, render the shark more lethargic and vulnerable to attack. By contrast, the flesh of seals, sea lions, and other natural prey of sharks has a high blubber content, which is easier for sharks to digest and which provides an energy-rich diet.

Shark attacks that occur on surfers are classified as "unprovoked" shark attacks, defined as incidents where an attack on a live human by a shark occurs in its natural habitat without human provocation of the shark. There are three major kinds of unprovoked shark attacks. By far the most common are "hit and run" attacks, which typically occur in the surf zone. Swimmers and surfers are the normal targets of such attacks. In "hit and run" attacks, the victim seldom sees its attacker, and the sharks do not return after inflicting a single bite or slash wound. In most instances, these attacks are believed to be cases of mistaken identity that occur under conditions of poor water visibility and a harsh physical environment (e.g., breaking surf and strong wash/current conditions).

The International Shark Attack File has officially documented unprovoked shark attacks since 1958. The number of unprovoked shark attacks has grown at a steady rate over the past century (see FIGS. 1-2). Overall, the 1990's had the highest attack total of any decade.

Many researchers in the field believe that the recent increase in the number of shark attacks is not the result of an increase in the aggressiveness of sharks towards humans, but arises instead from an increase in world population, coupled with a general increase in the amount of the time humans spend in the sea. Indeed, the number of shark-human interactions transpiring in a given year has been directly correlated to the amount of human time spent in the sea. As the world population continues to upsurge and the amount of time spent in aquatic recreation continues to rise, annual increases in the number of shark attacks on humans are expected to occur.

Referring again to FIGS. 1-2, the upward trend in shark attacks on humans is particularly troublesome for surfers, since surfers have experienced the highest percentage of unprovoked shark attacks in recent decades. This increase has been directly correlated to the increase in the popularity of the sport over this time period. The sharks that are most commonly involved in unprovoked attacks on surfers are the Great White *Carcharodon carcharias,* Tiger *Galeocerdo cuvier,* and the Bull shark *Carcharhinus leucas.* These sharks, known as the "Big Three" in the shark attack world, are large species capable of inflicting serious injuries to their victims, and are commonly found in areas where humans are in the water.

SUMMARY OF THE DISCLOSURE

In one aspect, an aquatic device is provided. The device is equipped with a light guide adapted to adsorb light which impinges upon a first portion of the device, and which is further adapted to emit light from a second portion of the device.

DETAILED DESCRIPTION

Without wishing to be bound by theory, it is believed that many shark attacks are cases of mistaken identity, in which the victim, such as a surfer on a surfboard, is confused with a seal, sea lion, sea turtle, or other natural prey of the shark. The confusion is believed to arise, in part, from the silhouette or shadow created by the surfer and surfboard, which may resemble the silhouette or shadow a shark associates with its natural prey.

It has now been found that the aforementioned problem may be addressed by modifying surf boards and other aquatic or flotation devices such that the silhouette or shadow created by these devices no longer resembles a silhouette or shadow which a shark might associate with its natural prey. This may be accomplished, for example, by equipping such devices with one or more light guides which are adapted to absorb light from a first portion of the device and to emit light from a second portion of the device. For example, such light guides may be adapted to receive a portion of light which impinges on the upper surface of the device, and to emit this light from a portion of the lower surface of the device. Preferably, the light guides are situated such that they emit light across a substantial portion of the lower surface of the device. Consequently, the silhouette of the device may be modified, and the shadow cast by the device as it moves through the water may be reduced or eliminated, such that these attributes of the device no longer resemble the attributes which sharks associate with their natural prey.

Figure 1:
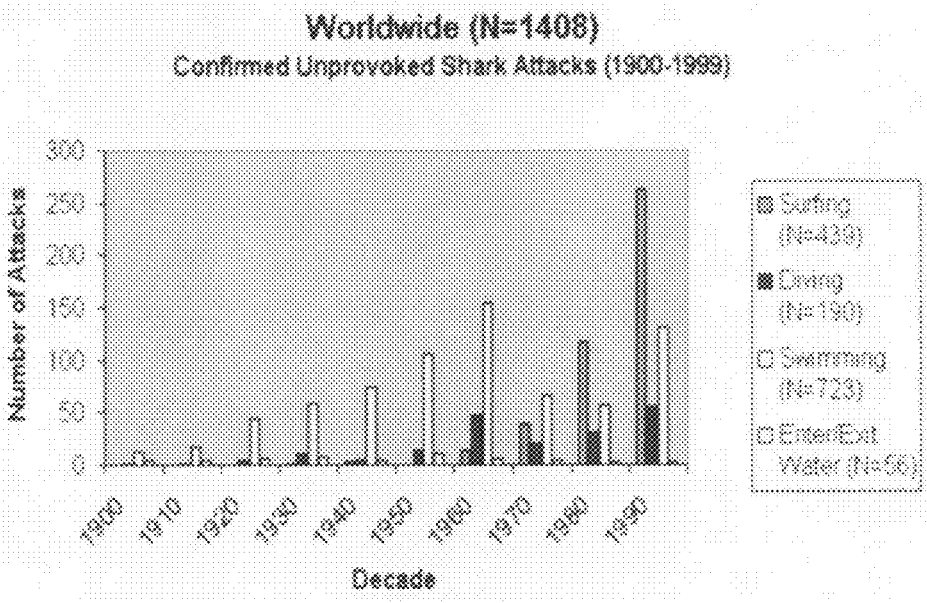
FIG. 1 is a graph depicting the number of shark attacks per decade.
Figure 2:
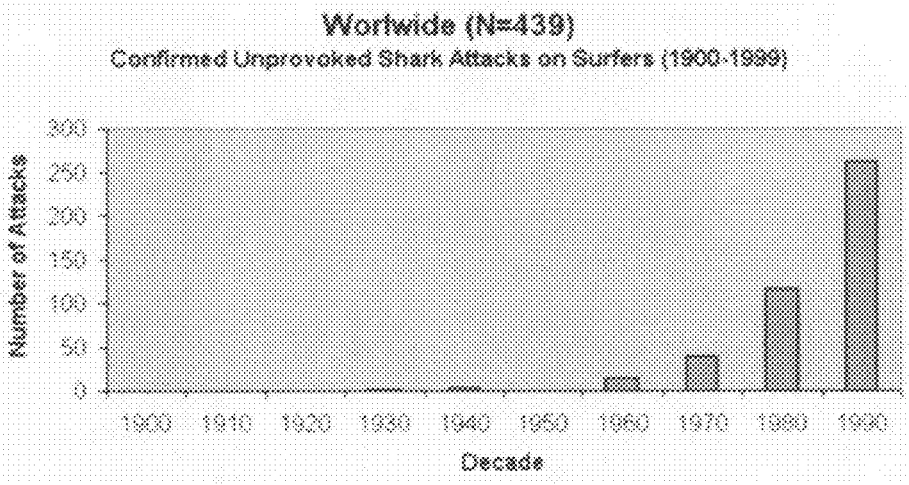
FIG. 2 is a graph depicting the number of shark attacks on surfers per decade.
Figure 3:
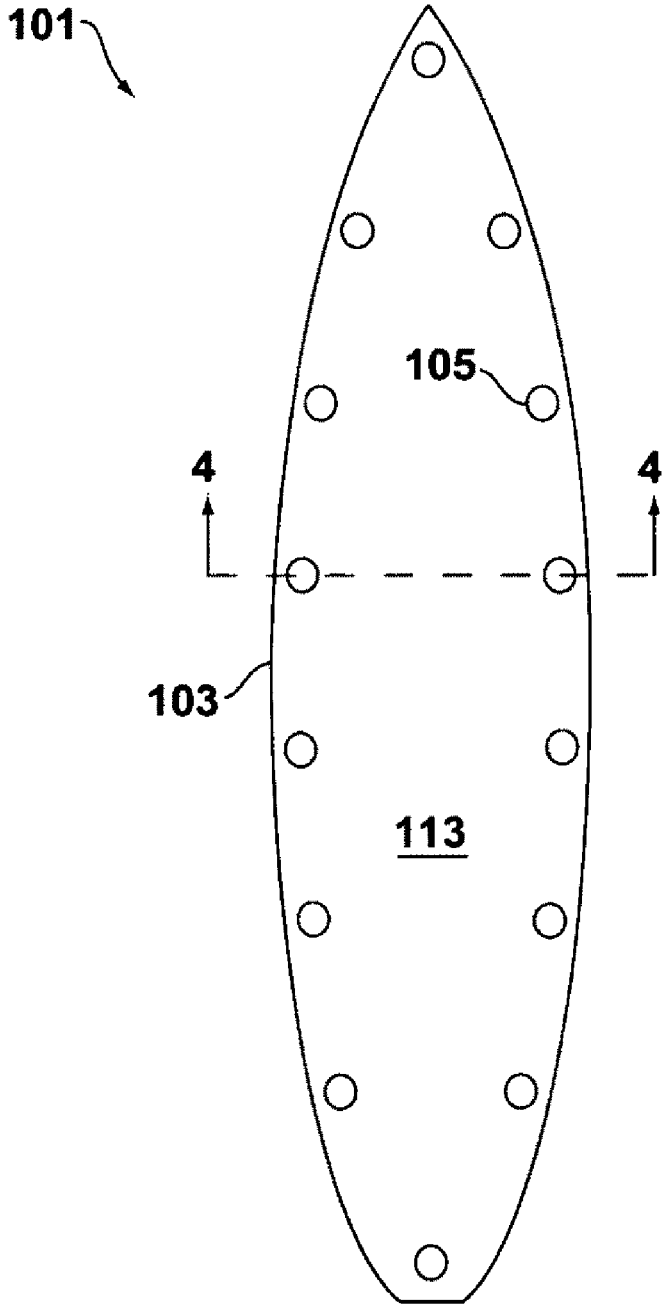
FIG. 3 is a top view depicting a first particular, non-limiting embodiment of a surfboard made in accordance with the teachings herein.
Figure 4:
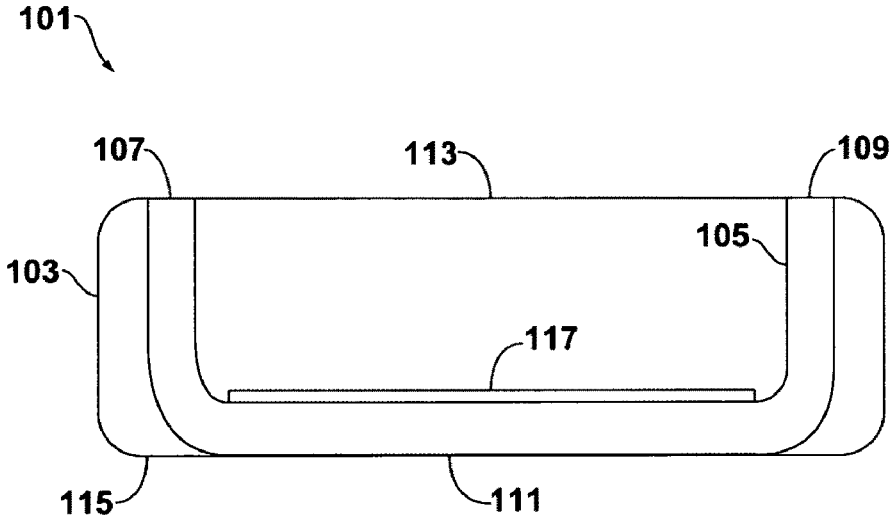
FIG. 4 is a cross-section taken along LINE 4-4 of FIG. 3.
Figure 5:
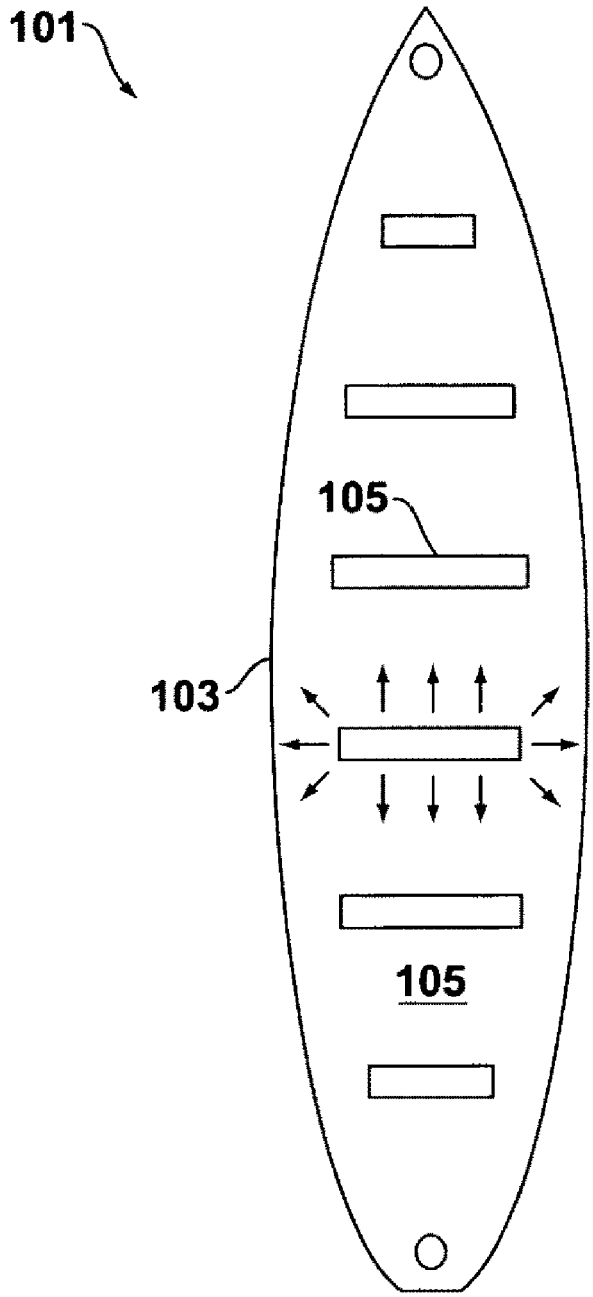
FIG. 5 is a bottom view of the device of FIG. 3.

FIGS. 3-5 depict a first particular, non-limiting embodiment of an aquatic device (a surfboard) made in accordance with the teachings herein. As seen therein, the device 101 comprises a buoyant core 103 which is equipped with a plurality of light guides 105.

As best seen in FIG. 4, the first 107 and second 109 terminal portions of the light guides 105 in this particular embodiment are disposed about the periphery of the upper surface 113 of the device 101, where they can absorb incident light with minimal interference from the user. The middle portion 111 of the light guide 105 is disposed adjacent to a second surface 115 of the device 101, and is equipped with a light extractor 117. The light extractor 117 extracts light through the opposing surface of the light guide 105 such that light is emitted from the bottom surface 115 of the device 101 as seen in FIG. 5.

Preferably, the device 101 is adapted such that light emitted from the light guides 105 provides somewhat even illumination of the bottom surface 115 of the device 101. This result may be achieved through suitable arrangement of the light guides 105. In some embodiments, the evenness of the illumination may be enhanced through the use of a light extractor 117 which diffusely scatters light through the opposing surface of the light guide 105. In other embodiments, a diffusely scattering optical film or material may be utilized to diffusely scatter light emitted from the light guide 105. Such a diffusely scattering optical film may be disposed, for example, on a surface of the light guide 105 opposite the light extractor 117, on the bottom surface 115 of the device 101, or between the light guide 105 and the bottom surface 115 of the device 101. In some embodiments, the light extractor itself may be a diffusely scattering optical film.

One advantage of the particular embodiment depicted in FIGS. 3-5 is that the light guides 105 are disposed so as to collect light which impinges on the periphery of the device 101, and to emit light from the bottom surface 115 of the device 101. Consequently, when the device is in use, the ends 107, 109 of the light guides 105 will typically not be covered by the body of the user, so that the ability of the light guides 105 to alter the silhouette of the device 101 and/or to eliminate or reduce the shadow cast by the device 101 will not be impaired.

Figure 6:
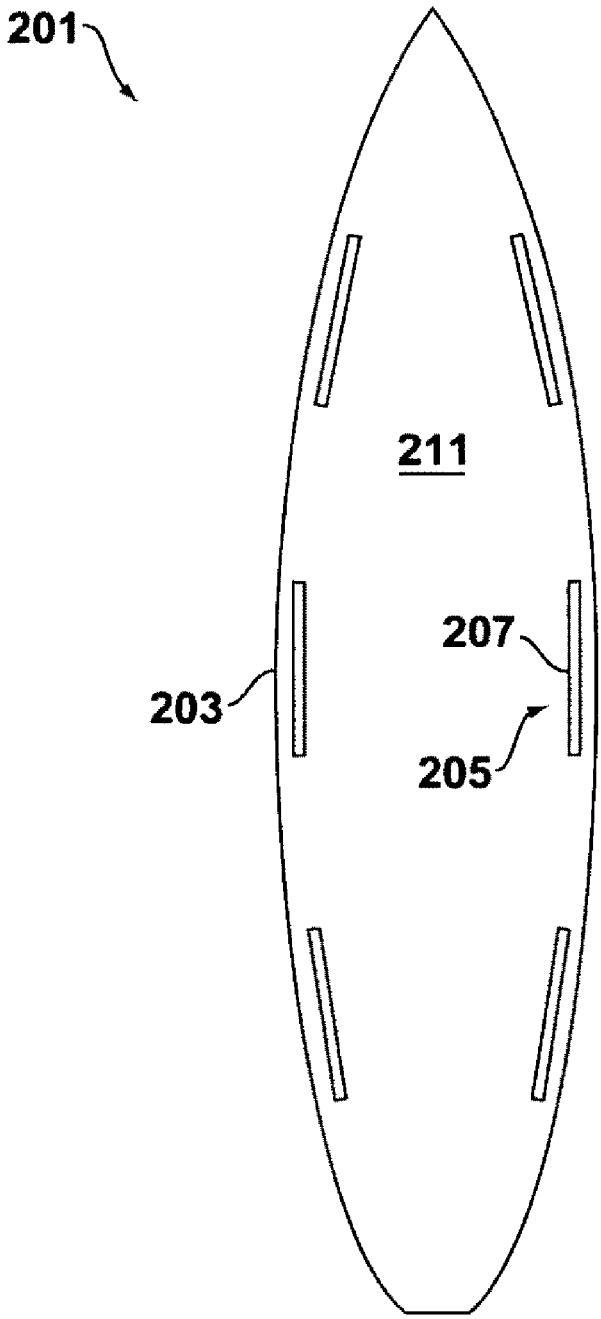
FIG. 6 is a top view depicting a second particular, non-limiting embodiment of a surfboard made in accordance with the teachings herein.
Figure 7:
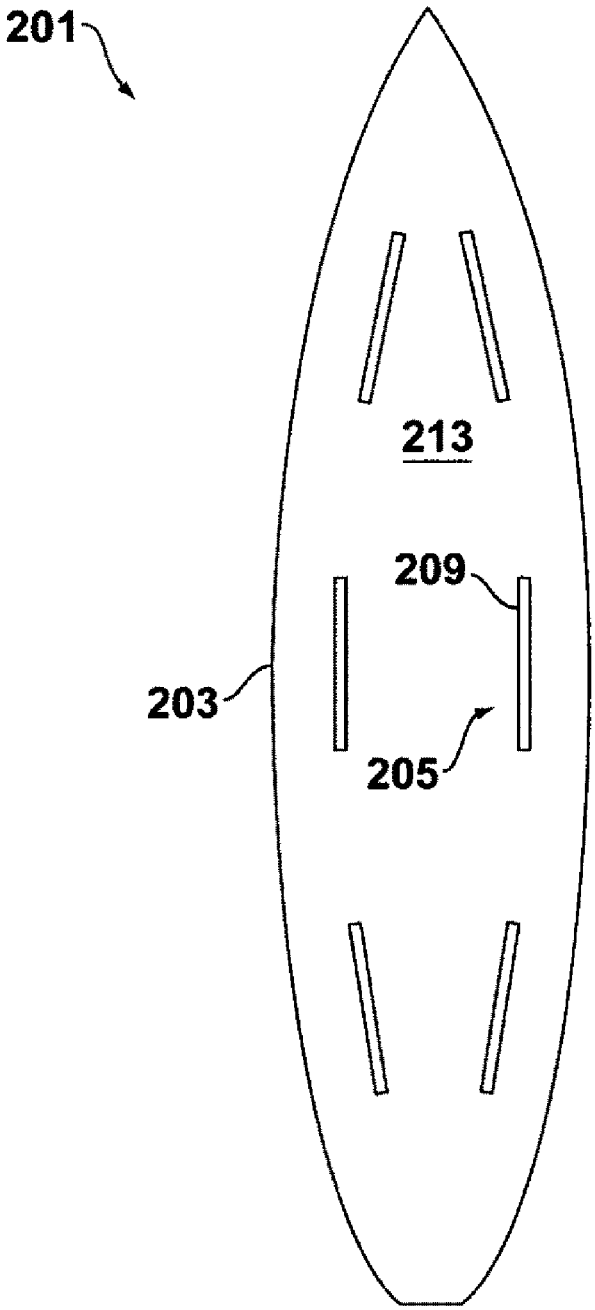
FIG. 7 is a bottom view of the device of FIG. 6.

FIGS. 6-7 depict a second particular, non-limiting embodiment of a device made in accordance with the teachings herein. The device 201 depicted therein comprises a buoyant core 203 which is equipped with a plurality of thin rectangular light guides 205. A first terminal portion 207 of each of the light guides 205 is disposed about the periphery of the upper surface 211 of the device 201 (see FIG. 7), and a second terminal portion 209 of each of the light guides 205 is disposed on the lower surface 213 of the device 201.

In some variations of this embodiment, the first 207 and second 209 terminal portions of each of the light guides 205 may be disposed on the upper surface 211 of the device, and suitable light extraction structures or techniques may be utilized to extract light from the middle of the light guide in a manner analogous to that depicted in the device of FIGS. 3-5.

Figure 8:
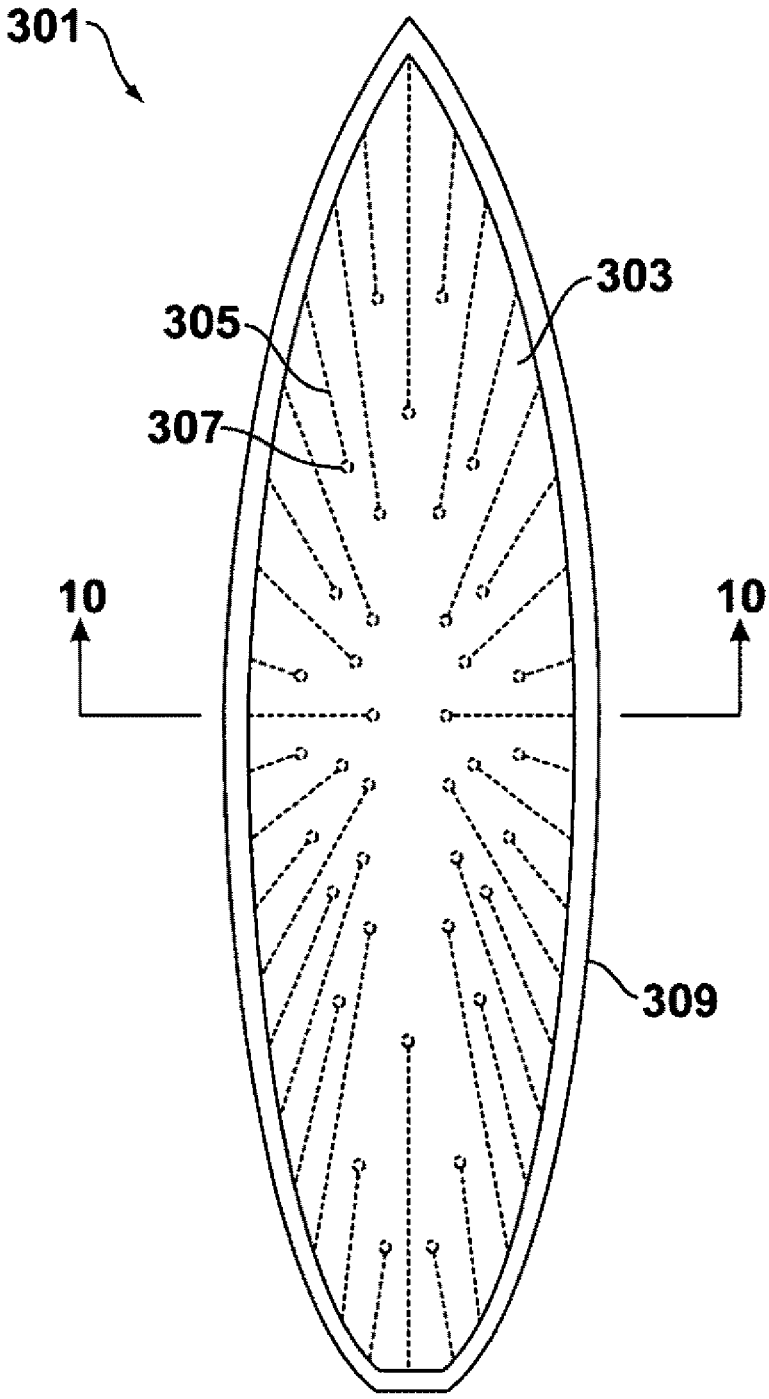
FIG. 8 is a top view depicting a third particular, non-limiting embodiment of a surfboard made in accordance with the teachings herein (the materials of the surface layers and core have been rendered transparent to show the details of the light guides).
Figure 9:
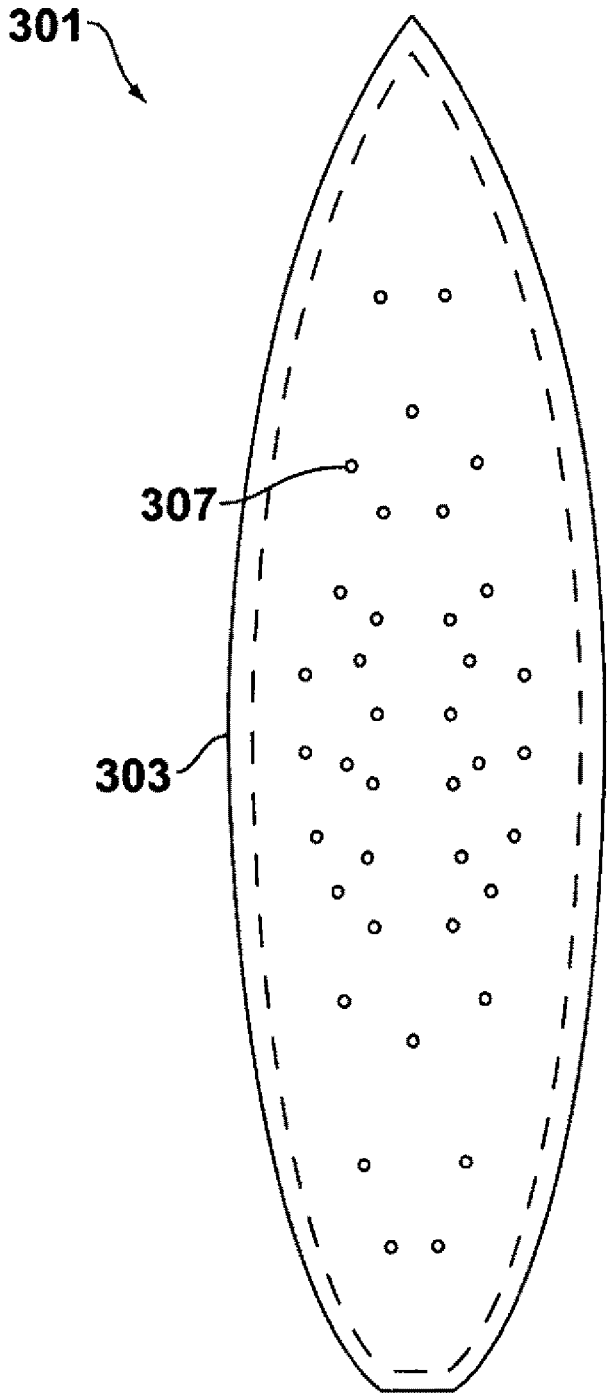
FIG. 9 is a bottom view of the device of FIG. 8.
Figure 10:
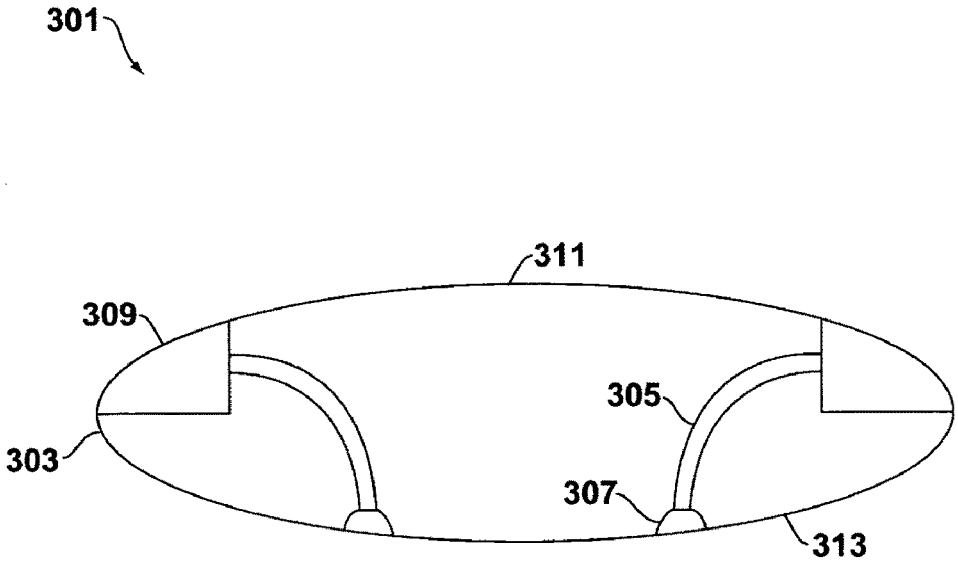
FIG. 10 is a cross-section taken along LINE 10-10 of FIG. 8.

FIGS. 8-10 depict a third particular, non-limiting embodiment of a device made in accordance with the teachings herein. The device 301 depicted therein comprises a buoyant core 303 which is equipped with a plurality of light guides 305 which, in this particular embodiment, are in the form of small diameter light guides or optical fibers. One end of each light guide 305 is in optical communication with a transparent window 309 or collector disposed about the periphery of the upper surface 311 of the device 301 (see FIG. 10). The opposing end of each light guide 305 is in optical communication with the lower surface 313 of the device 301 by way of an emitter 307.

In use, some of the light which impinges on the window 309 is transported through one of the light guides 305 and is emitted through the emitter 307 which terminates the opposing end of the light guide 305. The emitter 307 of each light guide 305 serves to scatter or broadcast the light in a desired pattern. Such a pattern may be selected, for example, to achieve a desired illumination of the bottom surface 313 of the device 301, or to reduce or eliminate the shadow cast by the device 301. It will be appreciated that the emitters 307 appearing on the bottom surface 313 of the device 301 may be disposed in various geometric patterns or arrangements to achieve desired optical effects.

Figure 11:
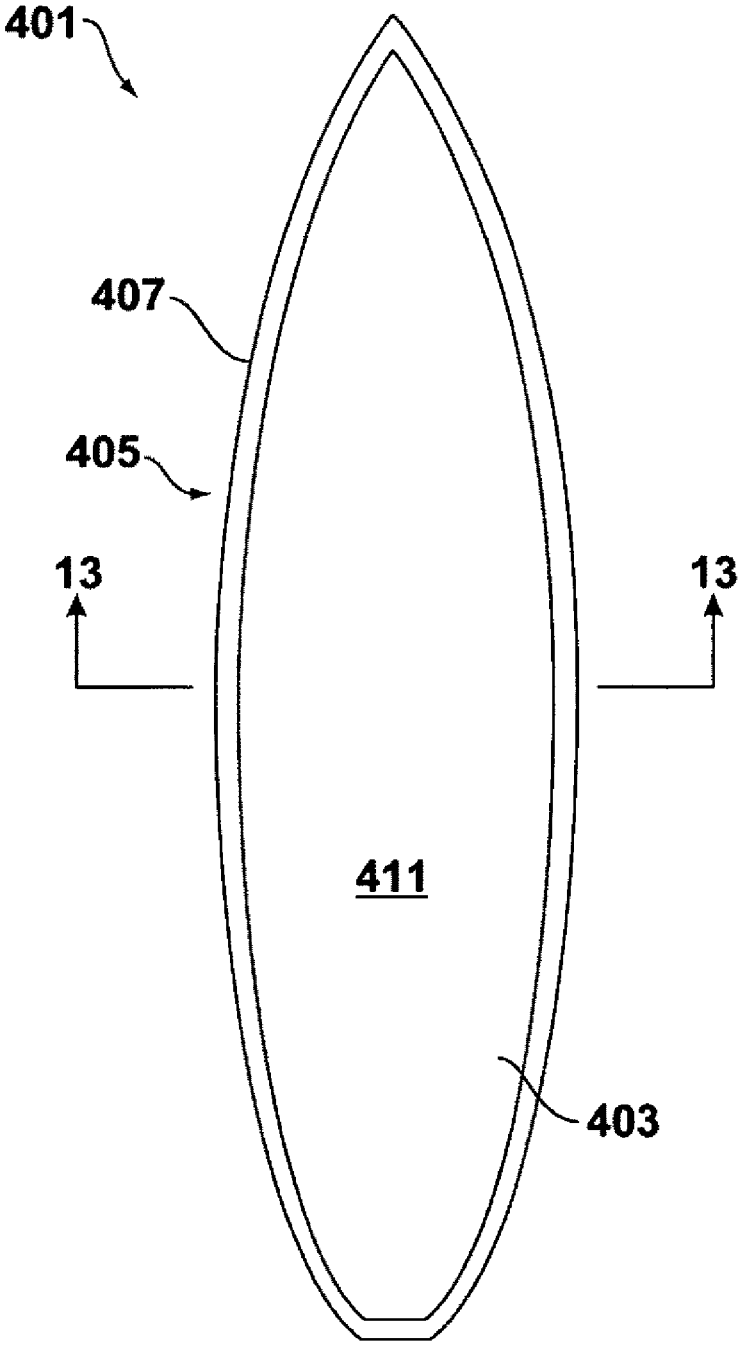
FIG. 11 is a top view depicting a fourth particular, non-limiting embodiment of a surfboard made in accordance with the teachings herein.
Figure 12:
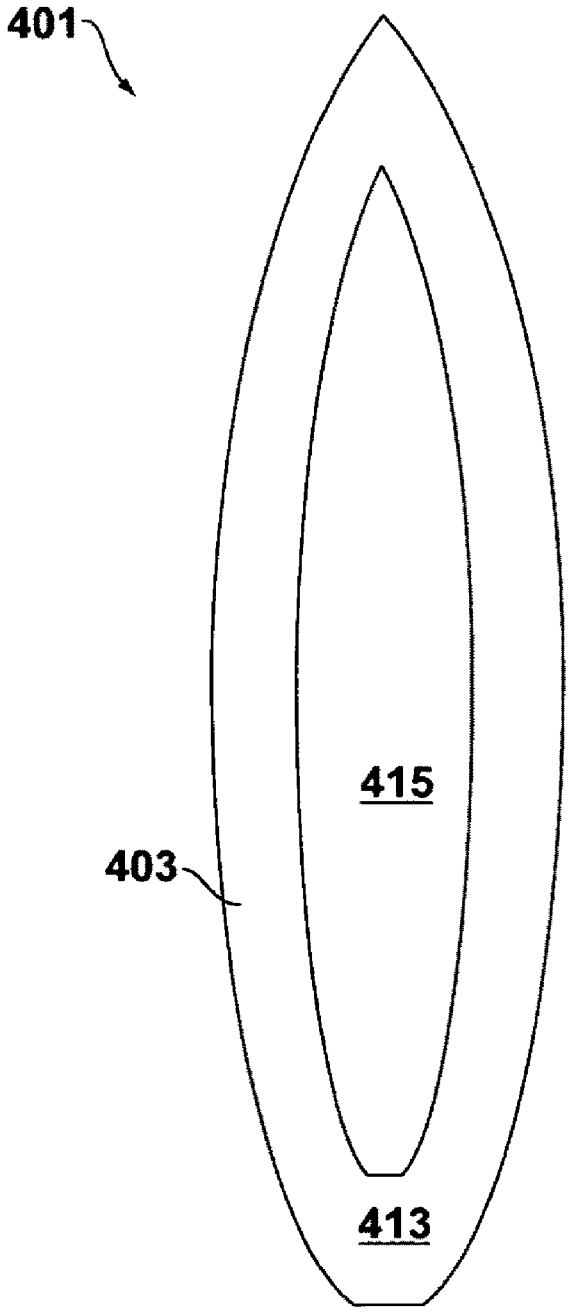
FIG. 12 is a bottom view of the device of FIG. 11.
Figure 13:
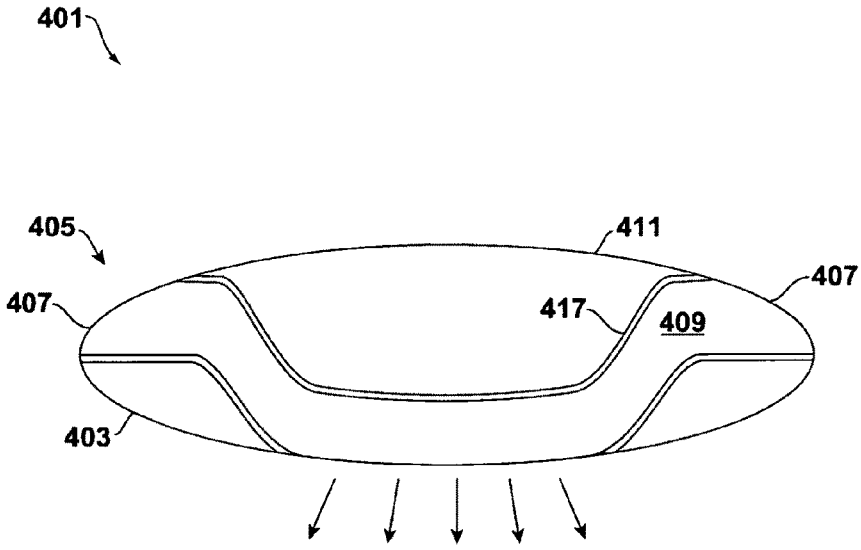
FIG. 13 is a cross-section taken along LINE 13-13 of FIG. 11.

FIGS. 11-13 depict a fourth particular, non-limiting embodiment of a device made in accordance with the teachings herein. The device 401 depicted therein comprises a buoyant core 403 which is equipped with a light guide 405. The terminal portions 407 of the light guide extend about the entire periphery of the upper surface 411 of the device 401 (see FIGS. 11 and 13). The light guide 405 in this particular embodiment preferably comprises a cavity 409 (see FIG. 13) which is lined with a reflective film 417, and which may be maintained under vacuum or filled with a suitable gas or liquid. The reflective film 417 (which may be, for example, a multilayer birefringent mirror film or a metal film) is removed from a middle portion 415 of the light guide 405 disposed adjacent to the bottom surface 413 of the device 401, thereby allowing light to exit along a central region of the bottom surface 413 of the device 401 as shown in FIG. 12. The middle portion 415 and terminal portions 407 of the light guide 405 are sealed with a suitable transparent material.

In use, light enters the terminal portions 407 of the light guide 405 and is reflected by the reflective film 415 until it exits the cavity 409 along the bottom surface of the device 401 as depicted in FIG. 13. The light guide 405 may be designed such that light entering the light guide 405 preferentially exits along the middle portion 415 of the light guide 405, rather than through the terminal portions 407 of the light guide 405.

In some variations of the foregoing embodiment, light pipes may be used in place of the light guide 405. In such embodiments, the cladding of the light pipe may serve as the reflective film 407.

Figure 14:
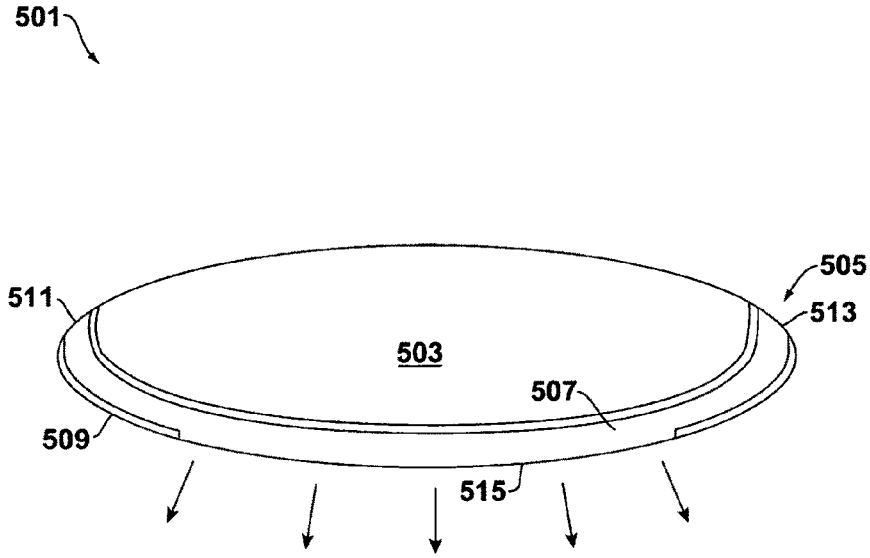
FIG. 14 is a cross-sectional view of a fifth particular, non-limiting embodiment of a surfboard made in accordance with the teachings herein.

FIG. 14 depicts a fifth particular, non-limiting embodiment of a device made in accordance with teachings herein (the top and bottom portions of this device 501 resemble FIGS. 11 and 12, respectively). The device 501 depicted therein comprises a buoyant core 503 equipped around the bottom periphery thereof with a light pipe 505 comprising a core 507 and cladding 509. The light pipe 505 has first 511 and second 513 terminal portions, and a middle portion 515 from which the cladding 509 has been removed from the outer surface thereof. In use, light enters the first 511 and second 513 terminal portions of the light pipe 505, and exits from the middle portion 515 as depicted. In variations of this embodiment, suitable light extractors or light extraction techniques may be employed to control or manipulate extraction of light through the middle portion 515.

Figure 15:
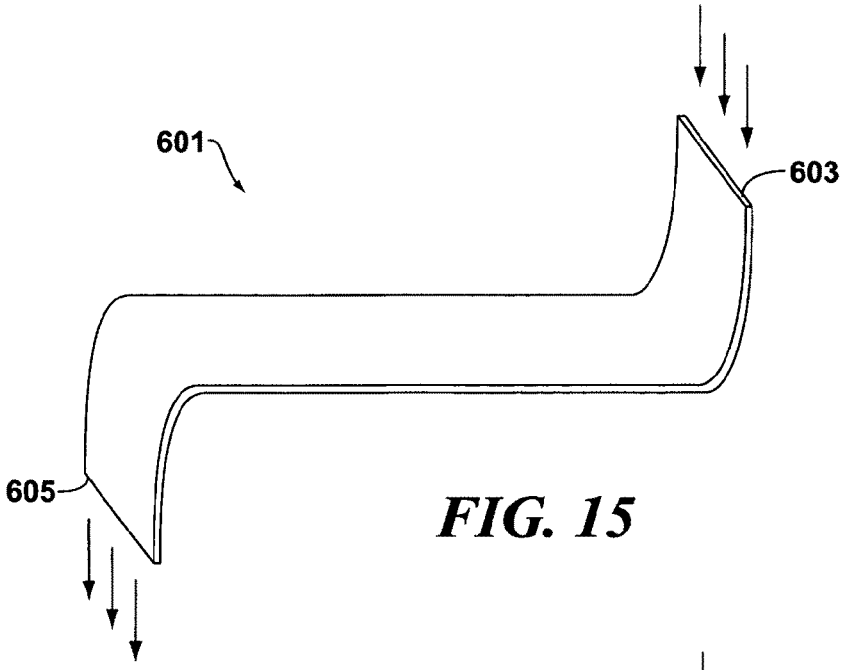
FIG. 15 is a perspective view of a light guide which may be used in some of the embodiments described herein.
Figure 16:
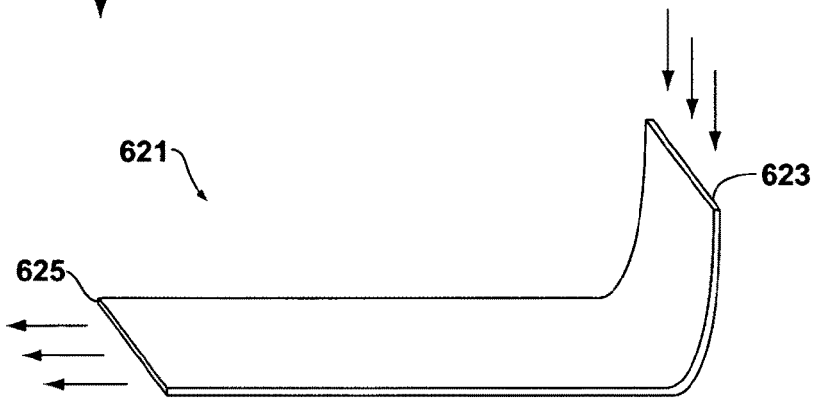
FIG. 16 is a perspective view of a light guide which may be used in some of the embodiments described herein.
Figure 17:
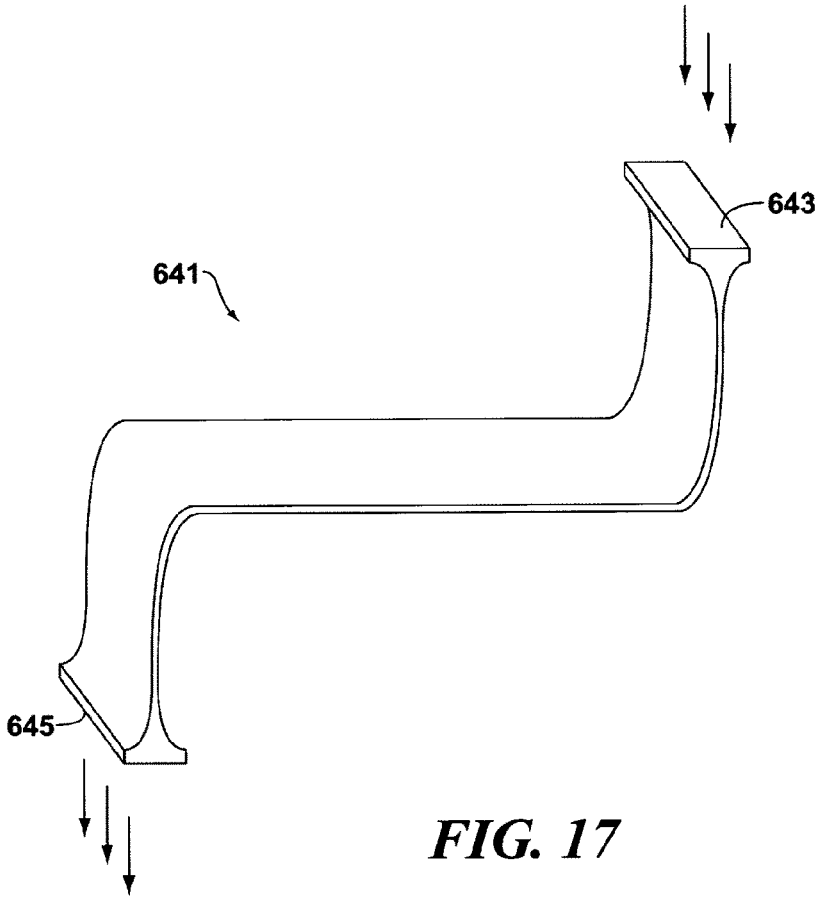
FIG. 17 is a perspective view of a light guide which may be used in some of the embodiments described herein.

FIGS. 15-17 depict various configurations of light guides which may be utilized in some of the devices described herein. With reference to FIG. 15, the light guide 601 depicted therein is generally S-shape in configuration. As seen therein, light enters a first terminal portion 603 of the light guide 601, and exits from a second terminal portion 605 of the light guide 601. Such a light guide may be useful in embodiments where it is desirable to collect light from a first surface and to emit light from a second surface which is generally parallel to the first surface.

The light guide 621 depicted in FIG. 16 is similar in construction and operation to the light guide 601 of FIG. 15, but has a generally J-shaped configuration. As seen therein, light enters a first terminal portion 623 of the light guide 621, and exits from a second terminal portion 625 of the light guide 621. Such a light guide may be useful in embodiments where it is desirable to collect light from a first surface and to emit light from a second surface which is generally perpendicular to the first surface.

The light guide 641 depicted in FIG. 17 is similar in construction and operation to the light guide 601 depicted in FIG. 15, except that the first 643 and second 645 terminal portions thereof have been tapered to facilitate the capture and emission of light over a wider area. One skilled in the art will appreciate that, in various embodiments possible in accordance with the teachings herein, one or both terminal portions of a light guide (including light guides which are not rectangular in cross-section) may be tapered in a similar manner.

Various types of light guides may be utilized in the devices and methodologies described herein. These include, for example, optical fibers, light pipes, light paths, and other such devices as are known to the art. In the case of optical fibers and light pipes, these devices will typically have a core and cladding structure whose respective indices of refraction are chosen or manipulated to induce total internal reflection. The materials of the core and/or cladding will typically comprise various polymeric materials or doped glasses.

The light guides utilized in the devices and methodologies described herein may have various geometries. For example, the light guides may be generally circular in cross-section as, for example, in the device depicted in FIGS. 3-4, or may be generally rectangular in cross-section as, for example, in the device depicted in FIGS. 5-7. In other embodiments, light guides may be utilized which are polygonal (including, for example, light guides which are triangular, square, pentagonal, hexagonal, or octagonal in cross-section), elliptical or irregular in cross-section.

Various light paths may be utilized in the devices and methodologies described herein. In some embodiments, such as the devices depicted in FIGS. 6-7, these light paths may be formed through the use of highly reflective films. Such films may be metal films formed, for example, from aluminum or silver, or may be birefringent optical films or other types of reflective or mirror films.

Birefringent optical films useful in the devices described herein may be formed, for example, as multilayer stacks of polymeric films for which the Brewster angle (the angle at which reflectance of p-polarized light goes to zero) is either very large or is nonexistent. Such an affect may be achieved by substantially matching the refractive indices in the thickness direction of adjacent layers within the film to produce a mirror film whose reflectivity either decreases slowly with angle of incidence, is independent of angle of incidence, or increases with angle of incidence away from the normal. As a result, such multilayer films have high reflectivity over a wide bandwidth. Optical films of this type may be constructed which behave as broadband mirrors, or which act as colored mirror films so that only light of certain wavelengths is reflected. Colored mirror films of various types and optical properties may be utilized in the devices described herein to produce a variety of desirable optical effects or designs.

Various multilayer birefringent optical films may be utilized in the devices and methodologies described herein. Such films may comprise, for example, layers of a first and second polymeric material, wherein at least one of the first and second polymeric materials has a positive stress optical coefficient (i.e., upon stretching, its index of refraction in the stretch direction increases). In one possible embodiment, the first polymeric material may be, for example, a crystalline or semi-crystalline naphthalene dicarboxylic acid polyester, such as a 2,6-polyethylene naphthalate (PEN), or may be a copolymer derived from ethylene glycol, naphthalene dicarboxylic acid and another suitable acid such as terephthalic acid (co-PEN). The second polymer may be, for example, a polyethylene terephthalate (PET) or a co-PEN. In such an embodiment, the average thickness of the layers of the first and second polymeric materials is preferably not more than 0.5 microns. Various distributions of layer thicknesses in these types of films may be utilized to achieve a variety of optical effects. Methods of forming films of this type are described, for example, in U.S. Pat. No. 5,882,774 (Jonza et al.), which is incorporated herein by reference in its entirety.

Various diffusely scattering films and materials may be utilized in the devices and methodologies described herein. Such scattering films may be utilized, for example, as light extraction materials for light guides (such as, for example, film 117 in FIG. 4), or to achieve more uniform scattering or illumination of the bottom surface of an aquatic device (as, for example, through appropriate forward scattering of the light emitted from a light guide).

Examples of such scattering films include those based on continuous/disperse phase materials. Such films may be formed, for example, from a disperse phase of polymeric particles disposed within a continuous polymeric matrix. In some embodiments, one or both of the continuous and disperse phases may be birefringent. Such a film may be oriented, typically by stretching, in one or more directions. The size and shape of the disperse phase particles, the volume fraction of the disperse phase, the film thickness, and the amount of orientation may be chosen to attain a desired degree of diffuse reflection and total transmission of electromagnetic radiation of a desired wavelength in the resulting film. Films of this type, and methods for making them, are described, for example, in U.S. Pat. No. 6,031,665 (Carlson et al.), which is incorporated herein by reference in its entirety. Analogous films in which the disperse phase comprises inorganic or non-polymeric materials (such as, for example, silica, alumina, or metal particles) may also be utilized in the devices and methodologies described herein.

In some embodiments of the devices in methodologies described herein, light-emitting panels may be utilized to more evenly distribute light over a wider surface area. Various types of light panels may be utilized for this purpose.

Figure 18:
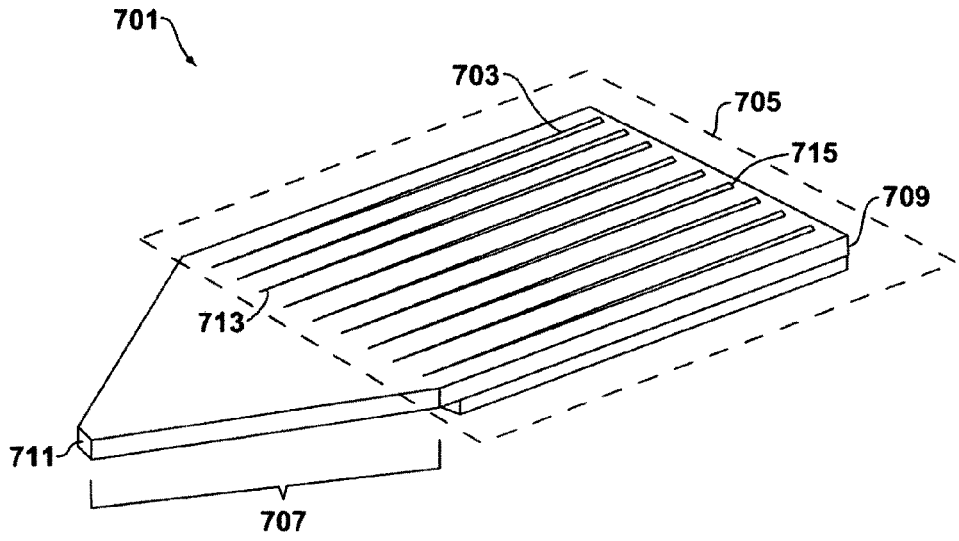
FIG. 18 is a perspective view of a light panel which may be utilized in the devices and methodologies described herein.

FIG. 18 depicts a particular, non-limiting example of a light-emitting panel which may be utilized in the devices and methodologies described herein. The panel 701 depicted therein comprises a tapered light-injection area 707 and a light-emitting zone 705. The light-emitting zone 705 may be rectangular in shape and is preferably equipped with a plurality of embedded light guides 703. The panel 701 is generally flat and has a base 709 which preferably comprises plastic (such as, for example, PMMA) or glass. The base 709 preferably has a transmittance of at least about 91% and a refractive index within the range of about 1.49 to about 1.51.

In operation, light flux from a light source enters the tapered light-injection area 707 at the narrow end 711 via an optical light pipe or fiber. The tapered light-injection area 707 serves as a coupling area from an optical light pipe or fiber to the light-emitting zone 705. The narrow end 711 is preferably sized and shaped to match the size and shape of the transporting light pipe or fiber, while the wide end of area 707 is preferably sized and shaped to match the size and shape of the end of light-emitting zone 705 proximate the light-injection area.

The light-injection area is typically constructed to be of sufficient length to preserve the light source radiant flux density over the area from the narrow end 711 to the proximal end of the light-emitting zone 705. The light flux is preferably evenly averaged and distributed across the proximal end of the light-emitting zone by total internal reflection. Additionally, the tapered light-injection area may be bent over a radius of 10 times one-half its thickness or greater. Once light enters the light-emitting zone 707 and the embedded light guides 703, both reflection and refraction modes of light propagation may occur.

The light-emitting zone 705 has at least one embedded irregular tetrahedrally-shaped light guide 703. The light guide 703 extends continuously from an end 713 proximate to the light-injection area 707 to a distal end 715 of the light-emitting zone 705. The multiple embedded irregular tetrahedron light guides may be arranged in parallel with respect to each other, depending on the particular application. Light travels from light-injection area 707 to the proximal end of the light-emitting zone 705, from which a portion of the light propagates through the base 709 and another portion propagates through the light guides 703 in a direction generally towards the distal end 715. Light is emitted from the panel 701 in a direction transverse to the propagation direction such that an area exposed to the light-emitting panel is illuminated continuously along the length of the light-emitting zone.

Figure 19:
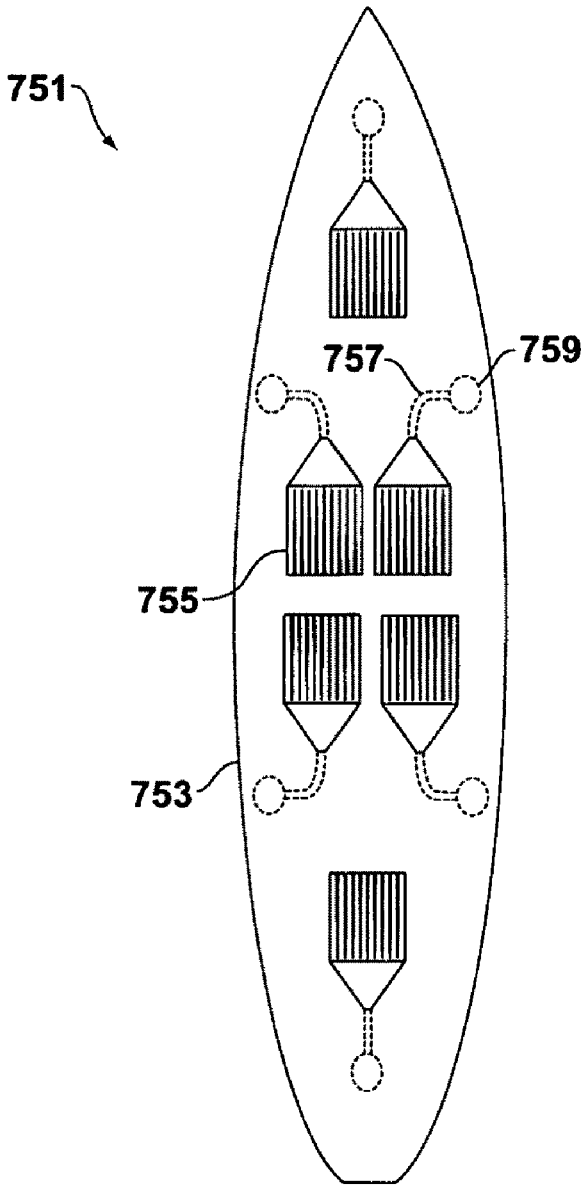
FIG. 19 is a bottom view of a surf board incorporating light panels of the type depicted in FIG. 18.

FIG. 19 depicts a sixth particular, non-limiting embodiment of a device made in accordance with teachings herein. The device 751 depicted therein comprises a buoyant core 753 which is equipped with a plurality of light panels 755 of the type depicted in FIG. 18. Each light panel 755 is equipped with a light guide 757 which is in optical communication with a collector 759 disposed at, or near, the surface of the perimeter of the device 751 in a manner similar to that depicted in FIG. 3. In use, light impinges on the collectors 759 and is emitted from the light panels 755 in a desired (and preferably uniform) manner.

Various means may be utilized to extract light from the light guides described herein. In a preferred configuration of a light guide utilized in the devices described herein, light is directed into one end (the light source end) of the light guide and propagates along the length of the light guide through total internal reflection. Since the available power is typically greatest at the source end of the light guide and falls off with increasing distance from the source end, extraction efficiency must typically increase with distance from the source end if uniform output is desired. This is especially true in embodiments where light is to be extracted over a substantial area or length of the light guide.

One extraction technique which may be utilized in the devices and methodologies described herein utilizes molded light extraction features to extract light from the light guide. Such molded light extraction features are typically three dimensional microstructures or textures patterned on a surface of the light guide which utilize total internal reflection to redirect light out of the opposing surface of the light guide. Molded light extraction features of this type may have various shapes, but are preferably in the form of spheres, prisms, or pyramids. Typically, the molded light extraction features will form linearly varying patterns, although in some embodiments, nonlinearly varying patterns may be utilized. For example, in some embodiments, the molded light extraction features may form patterns which vary in accordance with a quadratic Bezier curve.

Figure 20:
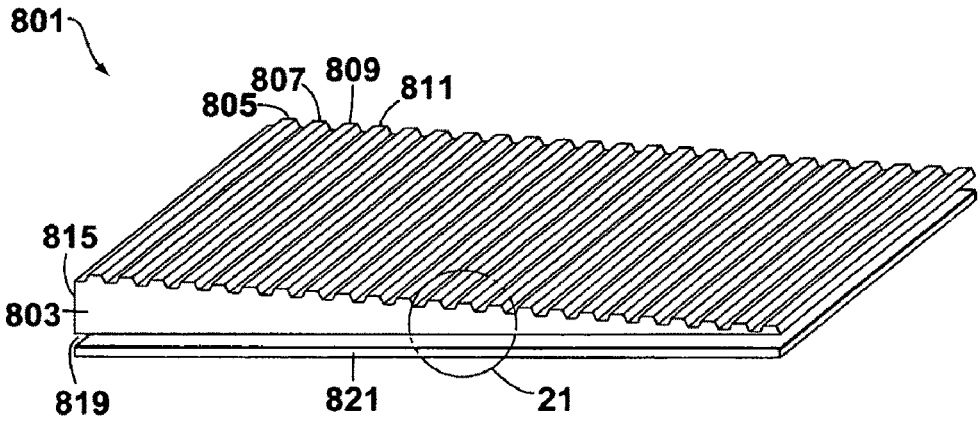
FIG. 20 is a perspective view of a wedge-shaped light guide which is suitable for use in some of the embodiments and methodologies described herein, and which is equipped with molded light extraction features.
Figure 21:
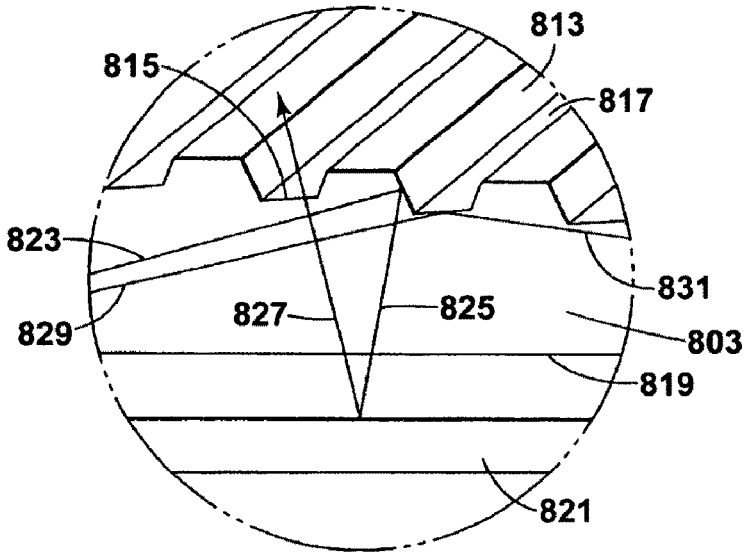
FIG. 21 is a magnified view of REGION 21 of FIG. 20.

One particular, non-limiting example of a molded light extraction feature suitable for use in some of the embodiments described herein is depicted in FIGS. 20-21. The device 801 depicted therein comprises a wedge-shaped light guide 803 which is disposed on top of a base 821. In the particular embodiment depicted, the light guide 803 and base 821 are separated by an air gap 819, though it will be appreciated that in some variations of this embodiment, the light guide 803 and base 821 may be in direct contact, or may be separated from each other by a suitable material which is transparent to the wavelengths of interest. In use, light enters the light guide 803 through a light input surface 815 and travels along the light guide 803 to strike facets on projections such as 805-811. The light input surface 815 may be in optical communication with another light guide or light source.

FIG. 21 shows a magnified view of a portion of the light guide 803 of FIG. 20. As seen therein, light ray 827 strikes facet 813 and is reflected downward as light ray 825 through output surface 819 towards light-emitting surface 821. Upon striking base 821 (and assuming that the base 821 is suitably modulated), the light ray 825 will be reflected upwards as light ray 827, reentering light guide 803 through surface 819 and then exiting light guide 803 through land 815. Light ray 829, which approaches the structured surface of light guide 803 along a different path than light ray 823, strikes land 817 and is reflected as light ray 831 towards surface 819 and the distal end (not shown) of the light guide 803. Owing to the slight upward tilt of land 817, ray 829 will strike land 817 (and reflected ray 831 will strike surface 819) at a higher angle of incidence than would be the case if land 817 were parallel to surface 819. For the same reason, reflected ray 831 will strike surface 819 at a point located closer to the distal end of light guide 803 than would be the case if land 817 were parallel to surface 819. This aids in the improved efficiency of extraction of light from light guide 803 by increasing the angle of incidence for light eventually reaching the facets.

Another extraction technique which may be utilized in the devices and methodologies described herein utilizes patterns of painted or printed dots on one surface of the light guide to scatter light out of the opposing surface of the light guide. Various parameters, such as dot width, dot height, and the spacing between dots, may be manipulated to create a desired extraction behavior.

A further extraction technique that may be utilized in the devices and methodologies described herein relies on the incorporation of scattering particles into the light guide itself. One particular, non-limiting embodiment of such a light guide is disclosed, for example, in U.S. Pat. No. 6,621,973 (Hoffman), which is incorporated herein by reference in its entirety. In such a light guide, if the size and density of such particles is controlled appropriately, scattering of light by the particles (which may be, for example, Mie or Rayleigh scattering) can occur, which can efficiently extract light from the light guide. In some embodiments, continuous/disperse phase films of the type described above may be utilized to extract light from a light guide in a similar manner (as, for example, by bringing such a film into optical communication with the core of a light guide).

It will be appreciated that the various components of optical systems utilized in the devices described herein may be coated or provided with materials having various transmission, reflectance, polarization, chromatic, and brightness enhancing properties. Thus, for example, the devices described herein may be provided with or used in conjunction with brightness enhancement films, color filters, or polarizing films or coatings.

In many of the embodiments of the devices and methodologies described herein, natural sunlight will serve as the light input source for the optical systems being utilized. However, in some embodiments, various artificial light sources may be utilized either in conjunction with, or in lieu of, natural sunlight. Such artificial light sources include, without limitation, various types of laser, incandescent, or LED sources. The wavelengths emitted by these artificial light sources may be selected to repel sharks, or to help distinguish the aquatic device from a shark's natural prey. In some embodiments, these light sources may operate off of suitable battery sources and/or solar power.

Various methods may be utilized to fabricate devices in accordance with the teachings herein. In a preferred embodiment, the light guides, which may be of discrete or continuous lengths, may be positioned and held in place by a jig or mold into which the material (typically expanded polystyrene (EPS) foam) of the core or blank of the aquatic device is injected. The mold may be removed, or may be integrated into the structure of the device.

Subsequent processing steps and layers of material may then be applied to form the finished product. If the aquatic device is a surfboard, the first steps of the process typically shape the board. In these steps, the board is sanded and/or planed until the desired shape is attained. Preferably, the shaping steps will expose the terminal ends of the light guides in the case of discrete length fibers or light pipes, or will remove the reflective coating from the exposed sidewalls of the light guide in cases where contiguous fibers or light pipes are utilized.

The next steps typically involve the application of a laminating resin (the base resin used in applying fiberglass cloth to the shaped blank), fiberglass cloth (typically 4 oz. and 6 oz. weight), surfacing resin (used to fill in the texture and lap seams in the cloth), and gloss resin (typically the final coat resin). The finish coat of gloss resin on the board is preferably transparent to prevent decrease of transmission. A diffuser/finish bottom-side pattern on the surfboard is typically applied either before or after the gloss resin step.

Various aquatic or flotation devices may be constructed in accordance with the teachings herein. These include, without limitation, surfboards, boogie boards, rafts, tubes, kick boards, and the like.

The above description of the present invention is illustrative, and is not intended to be limiting. It will thus be appreciated that various additions, substitutions and modifications may be made to the above described embodiments without departing from the scope of the present invention. Accordingly, the scope of the present invention should be construed in reference to the appended claims.

What is claimed is:

1. An aquatic device equipped with a light guide adapted to adsorb light which impinges upon a first portion of the device, and being further adapted to emit light from a second portion of the device;

wherein said first and second portions are disposed, respectively, on first and second opposing major surfaces of the device, wherein said light guide is equipped with a light extractor adapted to extract light from a portion of said light guide disposed along said second major surface, and wherein said light extractor comprises a feature selected from the group consisting of (a) a plurality of dots printed on a surface of the light guide (b) a continuous/disperse phase film in optical communication with said light guide, (c) a plurality of particles incorporated into said light guide, and (d) a plurality of molded light extraction structures.

2. The aquatic device of claim 1, further comprising a plurality of light guides, wherein each of said plurality of light guides has first and second terminal portions, and wherein the first terminal portion of each of said light guides is disposed near the periphery of said first major surface.

3. The aquatic device of claim 2, wherein the second terminal portions of each of said light guides are disposed across said second major surface.

4. The aquatic device of claim 2, wherein the second terminal portions of each of said light guides are also disposed near the periphery of said first major surface.

5. The aquatic device of claim 4, wherein said light guide is adapted to emit light from a middle portion disposed between said first and second terminal portions.

6. The aquatic device of claim 5, wherein said light guide comprises a core and cladding, and wherein said cladding is removed from at least part of said middle portion.

7. The aquatic device of claim 1, wherein said light extractor comprises a plurality of dots printed on a surface of the light guide.

8. The aquatic device of claim 1, wherein said light extractor comprises a plurality of molded light extraction structures.

9. The aquatic device of claim 1, wherein said light extractor comprises a plurality of particles incorporated into said light guide.

10. The aquatic device of claim 1, wherein said light extractor comprises a continuous/disperse phase film in optical communication with said light guide.

11. The aquatic device of claim 1, wherein said light guide is a light pipe.

12. The aquatic device of claim 1, wherein said light guide is an optical fiber.

13. The aquatic device of claim 1, wherein said light guide is a light path.

14. The aquatic device of claim 13, wherein said light path comprises a birefringent optical film.

15. The aquatic device of claim 14, wherein said birefringent optical film is a polymeric mirror film.

16. The aquatic device of claim 1, wherein said continuous/disperse phase film comprises a polymeric disperse phase disposed within a polymeric continuous phase.

17. The aquatic device of claim 1, wherein said device is adapted to emit light from a light-emitting panel disposed on the second portion of the device.

18. The aquatic device of claim 17, wherein said light emitting panel comprises a tapered light injection area and a light-emitting zone.

19. The aquatic device of claim 17, wherein the light emitting zone comprises a tetrahedrally shaped light guide.

20. The aquatic device of claim 8, wherein said molded light extraction structures comprise 3-dimensional microstructures.

21. The aquatic device of claim 8, wherein said molded light extraction structures comprise textures patterned onto a surface of the light guide.

22. The aquatic device of claim 1, further comprising an LED source which inputs light into said light guide.

23. The aquatic device of claim 1, wherein said aquatic device is a surf board.

* * * * *